United States Patent [19]

Folgero

[11] Patent Number: 4,559,632

[45] Date of Patent: Dec. 17, 1985

[54] CHANNEL-TYPE INDUCTION FURNACE OF THE TEAPOT TYPE

[75] Inventor: Kare Folgero, Västerås, Sweden

[73] Assignee: Asea Aktiebolag, Västerås, Sweden

[21] Appl. No.: 624,727

[22] Filed: Jun. 26, 1984

[30] Foreign Application Priority Data

Jun. 29, 1983 [SE] Sweden ..... 830371

[51] Int. Cl.[4] ..... H05B 5/14

[52] U.S. Cl. ..... 373/159; 373/161; 373/163

[58] Field of Search ..... 373/161, 143, 163, 156, 373/138, 159, 162, 160, 164

[56] References Cited

U.S. PATENT DOCUMENTS 1,552,865 9/1925 Metzger ..... 373/161

4,419,755 12/1983 Ohmori et al. ..... 373/159

4,441,191 4/1984 Fredrikson et al. ..... 373/163

FOREIGN PATENT DOCUMENTS 228087 10/1943 Sweden ..... 373/159

*Primary Examiner*—Roy N. Envall, Jr.

*Attorney, Agent, or Firm*—Kenyon & Kenyon

[57] ABSTRACT

A channel-type induction furnace of the teapot type comprising a crucible having a bottom, a channel-type inductor in the bottom and having a partially semi-circular channel opening into said bottom, and straight inlet and outlet melt conduits respectively extending to and from the bottom and positioned substantially tangentially with respect to said channel so as to extend straight into and from the channel.

2 Claims, 3 Drawing Figures

CHANNEL-TYPE INDUCTION FURNACE OF THE TEAPOT TYPE

A channel-type induction furnace of the teapot type comprises a crucible having a bottom, a channel-type inductor in that bottom, and inlet and outlet melt conduits on opposite sides of the crucible and respectively extending from a level above the crucible melt level to and from the bottom of the crucible or close to it. An example of such a furnace is illustrated by the Archenholtz U.S. Pat. No. 4,415,362.

The above furnace and others of its type can be tapped by tilting the furnace towards its melt outlet conduit, the melt inlet and outlet conduits being on the opposite sides of the crucible. Conventionally, the inductor is a separate unit attached to the crucible bottom. The inductor channel openings are consequently offset from the bottoms of the two melt conduits with the result that after tapping for the purposes of completely emptying the furnace crucible a sump of melt remains in the inductor channel. It takes an undesirable time for this sump to cool enough to permit servicing of the crucible and conduit refractory lining possibly requiring removal of the inductor.

Briefly summarized, the present invention is an improved channel-type induction furnace of the teapot type in which the inductor has a partially semi-circular channel opening into the crucible bottom, and straight inlet and outlet melt conduits respectively extending at opposite angularities to and from the crucible bottom and positioned tangentially with respect to the inductor's channel so as to extend straight into and from the channel. This construction permits the inductor to be made as an integral part of the furnace. All parts contacted by the melt must comprise a refractory lining of the usual type and with this new construction the crucible, inductor channel and the two conduits can be and are formed by a mutually integral refractory lining. The refractory lining is contained and supported by the usual steel shell construction and the inductor coil and core can be passed through the inductor lining via holes formed through the shell and the refractory of the furnace construction. However, all of the refractory lining of the inductor and crucible together with the conduit linings are integrated or monolithic.

With this new furnace a melt poured in the inlet conduit flows straight into the inductor channel and through it smoothly up into the crucible and the outlet conduit. With the inductor channel openings free from turbulent-creating deviations, the furnace operation is smoother, and tapping by furnace tilting creates less melt disturbance. Finally, when the furnace is to be shut down tilting can completely empty the entire furnace including the inductor channel. No sump remains in the furnace. Being completely empty of melt the furnace cools more quickly so that cleaning and repair of its entire lining can be carried out.

An example of the new furnace of this invention is shown by the accompanying drawings in which.

Figure 3:
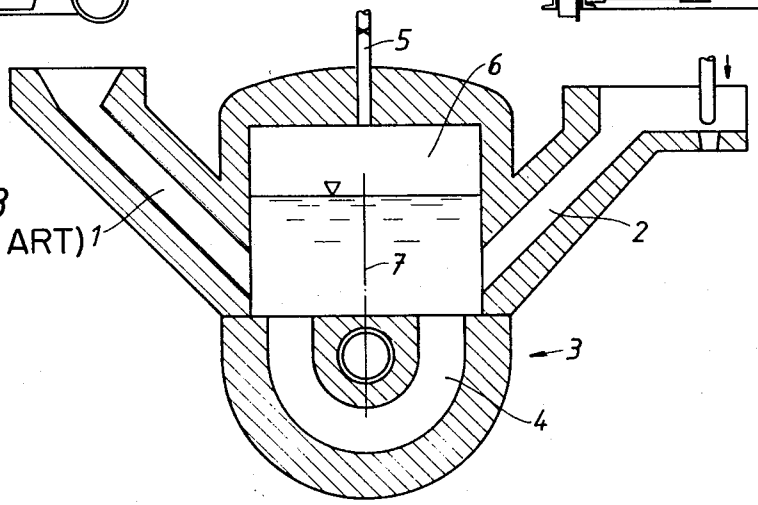
FIG. 3 (PRIOR ART)
FIG. 3 is a vertical section sideways of a conventional channel type induction furnace of the teapot type.

In FIG. 3 showing the conventional furnace the inlet and outlet melt conduits 1 and 2 respectively are straight. However, the removable inductor 3 must have its channel 4 out of alignment with the conduits. Such a furnace may characteristically have a gas inlet 5 opening into the space 6 which forms above a melt in the furnace. The inductor channel 4 is symmetrical with respect to the center line 7 of the furnace, but it is not only semi-circular but has straight vertical extensions leading to the bottom of the furnace crucible. There is no practical way to empty the channel 4 of its normal sump of melt.

Figure 2:
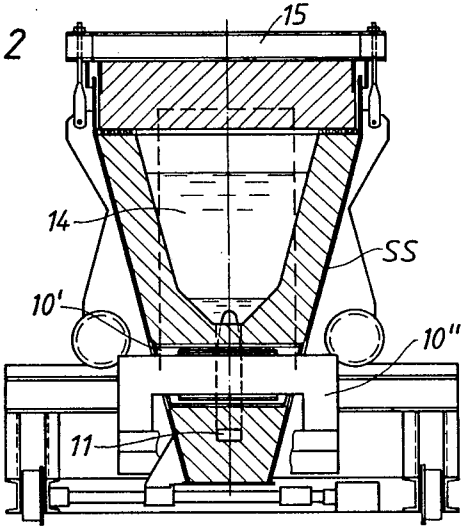
FIG. 2 is a vertical section showing the furnace endways.
Figure 1:
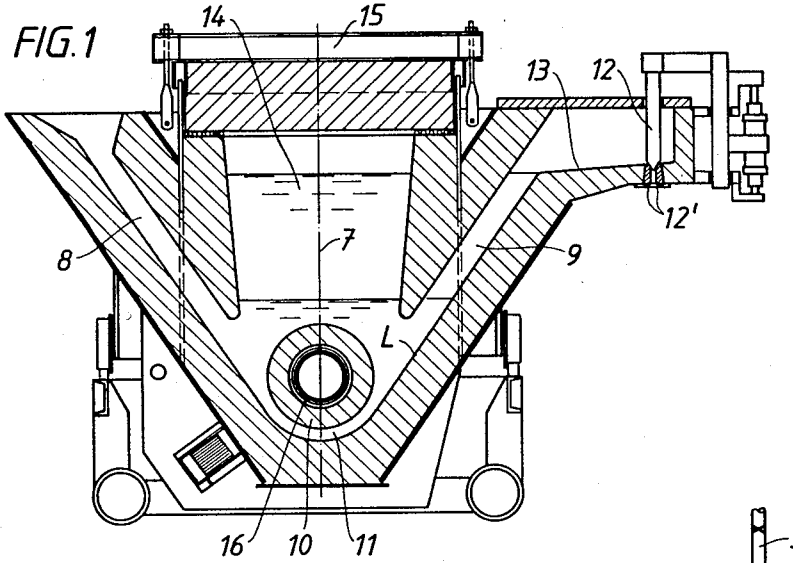
FIG. 1 is a vertical section showing the construction sideways.

The new furnace construction shown by FIGS. 1 and 2 has straight inlet and outlet melt conduits 8 and 9 respectively and its overall integral or monolithic lining is constructed so as to form a refractory inductor core lining 10 and a channel 11 of partially semi-circular contour and with which the conduits 8 and 9 extend tangentially. The integral or monolithic furnace lining and its steel shell SS are constructed to form side opening 10' through which the necessary inductor iron core 10'' can extend, this part being completely separated from the melt by the lining 10.

Tapping can be controlled by a stopper rod 12 for a stopper opening 12' in the top of the outlet 13 of the outlet conduit 9. The crucible 14 extends upwardly and may be provided with a pressure tight lid 15.

The furnace lining L extends integrally throughout the conduits 8 and 9, the inductor lining 10 and the lining of the crucible 14. Only the core and its winding or coil 16, are removable and they need not ordinarily be removed. The melt can flow into and from the inductor channel 11 with little or no turbulence and that for tapping the entire channel can be freed of sump metal by tilting. This is due to the straight conduits 8 and 9 and their tangential arrangement with respect to the partially semi-circular channel 11, permitting the conduits to extend straight to and from this channel without deviations of any kind.

What is claimed is:

1. A channel-type induction furnace of the teapot type comprising a crucible having a bottom and extending upwardly for containing a melt forming a melt level spaced above said bottom, a channel-type inductor in said bottom and having a partially semi-circular channel opening upwardly into said bottom, and inlet and outlet melt conduits on opposite sides of the crucible and respectively extending at opposite angularities from a level above said melt level to and from said bottom, said conduits being straight and positioned tangentially with respect to said channel and extending straight into and from said channel so that tilting of the furnace towards said outlet conduit permits any melt in the furnace to completely empty from said channel as well as from said crucible.

2. The furnace of claim 1 in which said crucible, inductor channel and inlet and outlet conduits are formed by a mutually integral refractory lining contained and supported by a steel shell, said inductor having a coil and a core passed through openings formed in the shell and lining.

* * * * *